US007172082B2

(12) United States Patent
Irsch et al.

(10) Patent No.: US 7,172,082 B2
(45) Date of Patent: Feb. 6, 2007

(54) MOBILE CRANE WITH A TELESCOPIC MAIN BOOM

(75) Inventors: Michael Irsch, Lebach (DE); Alexander Knecht, Zweibrücken (DE); Jens Fery, Ensdorf (DE)

(73) Assignee: Terex-Demag GmbH & Co. KG, Zweibruecken (DE)

( * ) Notice: Subject to any disclaimer, the term of this patent is extended or adjusted under 35 U.S.C. 154(b) by 248 days.

(21) Appl. No.: 10/480,705

(22) PCT Filed: May 31, 2002

(86) PCT No.: PCT/DE02/02061

§ 371 (c)(1),
(2), (4) Date: Dec. 11, 2003

(87) PCT Pub. No.: WO02/100756

PCT Pub. Date: Dec. 19, 2002

(65) Prior Publication Data

US 2004/0168997 A1 Sep. 2, 2004

(30) Foreign Application Priority Data

Jun. 11, 2001 (DE) ..... 101 28 986

(51) Int. Cl.
*B66C 23/42* (2006.01)

(52) U.S. Cl. ..... 212/231; 212/298; 212/299; 212/348

(58) Field of Classification Search ..... 212/298–299, 212/231, 348–349

See application file for complete search history.

(56) References Cited

U.S. PATENT DOCUMENTS

| | | | | |
|---|---|---|---|---|
| 4,412,622 | A * | 11/1983 | Gyomrey | 212/299 |
| 4,514,939 | A | 5/1985 | Rathe et al. | |
| 5,799,807 | A * | 9/1998 | Hamme | 212/299 |
| 5,884,791 | A * | 3/1999 | Vohdin et al. | 212/348 |

FOREIGN PATENT DOCUMENTS

| | | |
|---|---|---|
| DE | 30 15 599 | 10/1981 |
| DE | 198 02 187 | 7/1999 |
| EP | 1 065 166 | 1/2001 |
| GB | 2 096 097 | 10/1982 |

* cited by examiner

*Primary Examiner*—Thomas J. Brahan
(74) *Attorney, Agent, or Firm*—Cohen Pontani Lieberman & Pavane LLP

(57) ABSTRACT

A mobile crane includes an under carriage, a superstructure that is rotatably mounted on the superstructure, and a main boom, which is composed of a base body and several telescopic lengths up to a predetermined maximum number, which slide into one another and can be extended from the base body. The main boom is mounted on the superstructure so that it can rotate about a horizontal axis and its inclination can be adjusted by means of a hydraulic tilting cylinder that is hinged on the superstructure and the base body. A maximum permissible weight is predefined for the main boom, as a result of a restriction on the permissible axle load of the mobile crane during road haulage. The crane is also provided with a lifting capacity increasing device, which significantly increases the lifting capacity of the main boom when the telescopic lengths are extended, in relation to the state without the lifting capacity increasing device. The lifting capacity increasing device, as part of the standard basic equipment of the mobile crane, is connected in a fixed manner to the main boom, while maintaining the maximum number of telescopic lengths that are carried.

15 Claims, 4 Drawing Sheets

MOBILE CRANE WITH A TELESCOPIC MAIN BOOM

PRIORITY CLAIM

This is a U.S. national stage of application No. PCT/DE02/02061, filed on 31 May 2002. Priority is claimed on that application and on the following application: Country: Germany, Application No.: 101 28 986.3, Filed: 11 Jun. 2001.

BACKGROUND OF THE INVENTION

1. Field of the Invention

The invention pertains to a mobile crane with an undercarriage and with a superstructure mounted rotatably on the undercarriage, which superstructure has a main boom consisting of a base box unit and several telescoping sections, up to a maximum predetermined number of which are guided inside each other and can be extended telescopically from the base box unit. The main boom is supported on the superstructure so that it can rotate around a horizontal axis, and its rake can be adjusted by means of a hydraulic luffing ram hinged to the superstructure and to the base box. For a mobile crane of this type, the axle loads which the crane can accept as it is traveling over the highway represent a limit on the total allowable weight of the main boom. A lifting capacity increasing arrangement provided at least temporarily on the main boom can increase the lifting capacity of the fully extended main boom significantly beyond that which would be the case without the lifting capacity increasing arrangement.

2. Description of the Related Art

A crane of this type is known from, for example, DE 31 13 763 A1, which corresponds to GB 2,096,097. The lifting capacity increasing arrangement described here consists of a cable guying system with two cables, which are nearly parallel to the load plane, that is, to the plane defined by the hoist cable and the longitudinal axis of the main boom. The cables are attached to a point at the upper end of the extended main boom and are trained over a guy support, which extends upward at approximately a right angle to the longitudinal axis of the main boom. The other end of the guying is attached to the base of the base box of the main boom. This guying brings about a considerable increase in the stiffness and buckling strength of the extended main boom in the load plane. As a result, the lifting capacity of the main boom is also considerably increased.

A similar lifting capacity increasing arrangement in the form of cable guying is known from DE 198 02 187 A1. Here, one end of the hauling cable used for the guying is permanently connected to a boom extension, which is attached to the head of the extended main boom. The other end of the hauling cable is again wound up on a mechanically actuated cable drum, which is attached to a guy support connected to the base box of the telescoping boom. The hauling cable is trained over a return sheave at the tip of the guy support and proceeds to the cable drum. The tip of the guy support itself is connected to the base of the base box of the telescoping boom by a fixed length of guying. Thus the overall guying system consists of a fixed length part and a variable length part. As a result, the length of the guying can be easily adjusted to the length to which the telescoping boom has been extended in the case at hand.

Another lifting capacity increasing arrangement in the form of cable guying is known from EP 1 065 166 A2. The special feature here is that the guy support is formed by two separate mast-like struts, which are both set up essentially at right angles to the longitudinal axis of the telescoping boom, but spread away from each other; that is, they enclose an angle between them which is in the range of, for example, 90°. When the boom is in a horizontal position, the two struts of the guy support therefore do not point vertically upward but rather slant in an upward direction. Guying cables, which are attached to the upper end of the telescoping boom, are trained over return sheaves, one of which is on each of the two struts of the guy support, and proceed from there to cable drums. It is obvious that the cable drums could also be mounted at the tops of the actual struts, which would make it possible to eliminate the return sheaves. The upper ends of the struts are connected in turn by way of guying of fixed length to the base area of the telescoping boom. Because the two struts of the guy support are separated, the two guying cables are at a corresponding angle to each other outside the load plane. In this way, it is possible to stabilize the telescoping boom in two planes, namely, within the load plane and also transversely to the load plane. In contrast to the previously cited lifting capacity increasing arrangements, therefore, the lateral area of the telescoping boom is also stabilized.

The guy support with cable drums and cabling requires additional space on the telescoping boom; the amount of space required is therefore significantly reduced by designing the guy support so that it can be folded down. This additional arrangement, however, also leads to a considerable increase in overall weight. Because the weight of the boom cannot exceed the axle load limits that the mobile crane can accept when the crane is traveling over the road, a mobile crane with a telescoping boom cannot usually travel by road when it is equipped with a premounted lifting capacity increasing arrangement in the form of cable guying. The lifting capacity increasing arrangement must usually be transported separately and then mounted on the crane at the construction site when the crane is needed. As a way of avoiding this problem, it is sometimes possible to compensate for the increase in weight caused by the lifting capacity increasing arrangement by temporarily removing one or more of the telescoping sections from the boom. The disadvantage of this, however, is that the maximum length of the boom then available is reduced to a corresponding extent.

The ultimate goal is to have a telescoping-boom mobile crane which has a boom of the greatest possible length but which also has the greatest possible lifting capacity, that is, which can lift the greatest possible load. An increase in the working load capacity can be obtained in principle by a more solid design of the profiles used for the individual telescoping sections. This, however, would lead in turn to a corresponding increase in weight, which is not usually permitted because of the axle load limitations.

SUMMERY OF THE INVENTION

The task of the present invention is to improve the mobile crane of the general type in question in such a way that the extent to which the boom can be extended for a given lifting capacity is significantly increased without causing an unallowable increase in the total weight of the boom and thus without exceeding the axle load limits or to improve the crane in such a way that, for a given maximum extension, the working load (lifting capacity) is increased without any change in the previously mentioned limiting conditions.

According to the invention, the lifting capacity increasing arrangement, which previously was always mounted as a separate accessory on the mobile crane, is now a part of the standard, basic equipment of the mobile crane, and the maximum number of telescoping sections that can be carried along are always permanently connected to the main boom. This implies that it is not necessary to eliminate a telescoping section from the boom to compensate for the weight of the lifting capacity increasing arrangement. The weight of the lifting capacity increasing arrangement is thus to be considered part of the weight of the main boom from the very beginning, but since the main boom does not exceed the maximum allowable weight, there is no need to reduce the number of telescoping sections. This is possible because, to compensate for the weight of the lifting capacity increasing arrangement, the individual telescoping sections are made lighter in weight than the sections of conventional design, so that the ratio of the top weight $G_K$ to the base weight $G_F$ of the completely extended main boom does not exceed 40:60. The top weight $G_K$ preferably constitutes no more than 38% of the total weight of the main boom. In an actual case, the ratio $G_K$:$G_F$ will be in the range of 40:60 to 30:70. The total weight of the main boom is thus also kept the same as that of a boom of conventional design by compensating for the increase in weight attributable to the lifting capacity increasing arrangement by reducing the weights of the individual telescoping sections.

This reduction in the weights of the individual telescoping sections can be achieved advantageously at least in part or even entirely by a reduction in the wall thickness of the telescoping sections. In particular, it is a possible to reduce the thickness of the sidewalls, i.e., the walls parallel to the load plane. The lifting capacity increasing arrangement must therefore increase the lifting capacity at least enough to compensate for the decrease in said capacity associated in principle with this reduction in weight.

It is obvious that it is also possible to reduce the weight of the individual telescoping sections at least in part or even entirely by reducing the cross-sectional dimensions of the telescoping sections. This can be achieved preferably by reducing the width (transverse to the load plane) of the cross section; the height of the cross section can remain unchanged or can be reduced to a lesser extent that the width of the cross section. Of course, a reduction in the cross-sectional dimensions of the telescoping sections, which are usually designed with an essentially box-like profile, can also be combined with a reduction in wall thickness in comparison with walls of conventional cross-sectional design.

The lifting capacity increasing arrangement is preferably designed in such a way that it increases the stiffness of the main boom in the load plane. As a result, it is possible, for example, to reduce the height of the cross section and/or the wall thickness in the upper chord and/or in the lower chord of the telescoping section profile.

When the width of the cross section of the individual telescoping sections is reduced and the height of the cross section remains unchanged or is reduced to a lesser degree, a lifting capacity increasing arrangement is obtained which is designed to increase the stiffness of the main boom transversely to the load plane. It is especially advantageous, however, to use a lifting capacity increasing arrangement that has the effect of increasing the stiffness of the main boom both in the load plane and also in the plane transverse to the load plane.

It is effective to design the lifting capacity increasing arrangement in the manner known in and of itself in the form of guying, which extends from a point at the upper end of the main boom to a point at the base of the main boom. The upper attachment point of the guying does not have to be at the very tip of the extended telescoping boom; it could be connected, for example, to the collar of the next-to-last telescoping section or of some other section. In a corresponding manner, the lower attachment point of the guying does not necessarily have to be at the extreme bottom end of the base of the boom. Other attachment points are also possible, such as a point in the area of the counterweights, which are usually mounted on the superstructure.

It is recommended that the guying consist, also in the manner known in and of itself, of a variable length part and a fixed length part. The fixed length part extends from the tip of the guy support to the base area of the main boom, whereas the variable length part extends from a point near the upper end of the main boom to the cable drum on the guy support. In principle, the lifting capacity increasing arrangement designed as cable guying can consist of a single strand. It is recommended in most cases, however, that a mirror-image arrangement with respect to the load plane be used, in that two separate guying strands are provided, each of which, obviously, can again consist of a fixed length part and a variable length part. Correspondingly, then, the guy support will also have two separate struts, over which the guying is trained. The struts can be adjustable in terms of the angle they form with each other; the angle enclosed between their longitudinal axes will be adjusted on the basis of the requirements of the actual situation. It is therefore possible to adjust the degree to which the stiffness is increased in the load plane and also in the plane transverse to the load plane. In this case, the degrees of stiffness will change in opposite directions.

In another advantageous embodiment, the invention provides that the cable drum or cable drums are designed so that they can be easily removed, which allows the cable drum in question and the guying cable wound up on it to be transported separately. As a result, the weight of the main boom can, if necessary, be reduced below the critical limit without leading to the need for extensive rigging work at the construction site to make the mobile crane ready for service. The cable drum or cable drums can be easily remounted.

The present invention can be used to great advantage even in small mobile cranes with, for example, three axles, as well as in the larger mobile cranes with, for example, up to nine axles.

BRIEF DESCRIPTION OF THE DRAWINGS

FIG. 5 shows a telescoping boom with a lifting capacity increasing arrangement acting both in the load plane and in the plane transverse to that.

DETAILED DESCRIPTION OF THE PRESENTLY PREFERRED EMBODIMENTS

Figure 1:
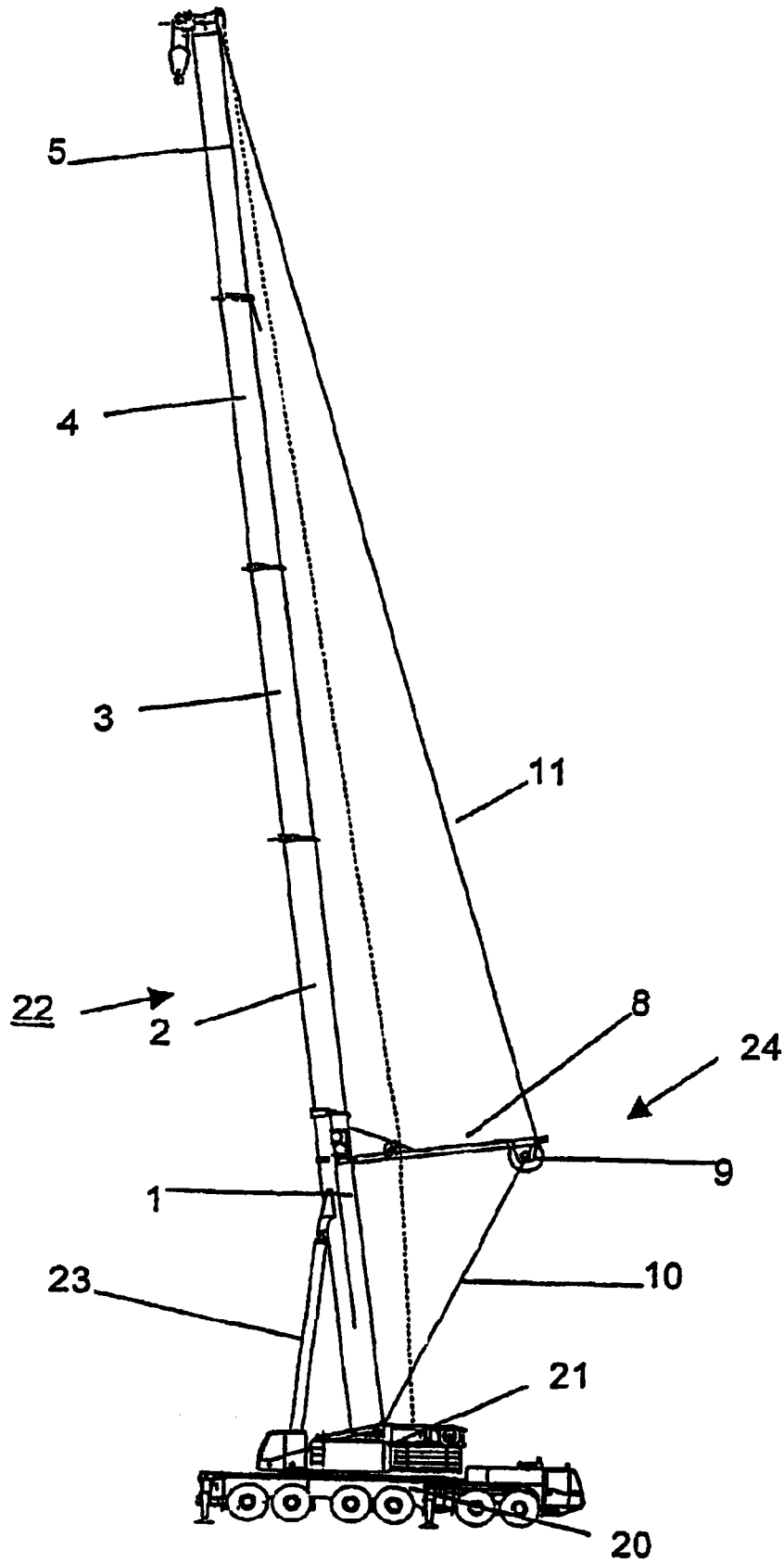
FIG. 1 shows a mobile crane with an extended telescoping boom and a lifting capacity increasing arrangement.

The mobile crane shown in FIG. 1 has an undercarriage 20 comprising a road transport unit with six axles. A superstructure 21 is mounted on the undercarriage 20 so that it can rotate around a vertical axis. A main boom 22 is supported on the superstructure 21 so that it can rotate around a horizontal axis. The main boom 22 consists in the present case of a base box unit 1 and a total of four telescoping sections 2–5, which can be extended out from the base box. The horizontal swivel joint is mounted at the base of the base box unit 1. The rake of the main boom 22 can be adjusted as desired by means of a hydraulic luffing ram 23. The main boom 22 is provided with a lifting capacity increasing arrangement 24, shown schematically, which has a guy support 8, which is mounted on the back of the base box unit 1 and extends out at essentially a right angle to the longitudinal axis of the main boom 22. Additional essential parts of the lifting capacity increasing arrangement 24 are the lower guying 10, which extends from the base of the base box unit 1 to the tip of the guy support 8, and the upper guying 11, which extends from a point at the upper end of the main boom 22 to the guy support 8. In the normal case, the length of the lower guying 10 is fixed. Therefore, this part of the lifting capacity increasing arrangement can also be made up of suspension rods. Of course, a fixed length of cable can also be used. The upper guying 11 is advisably designed as a cable guying, because then the greatest flexibility is obtained with respect to the length to which the telescoping boom 22 can be extended. The length of the upper guying 11 can be easily varied by the use of a cable drum 9.

Figure 2:
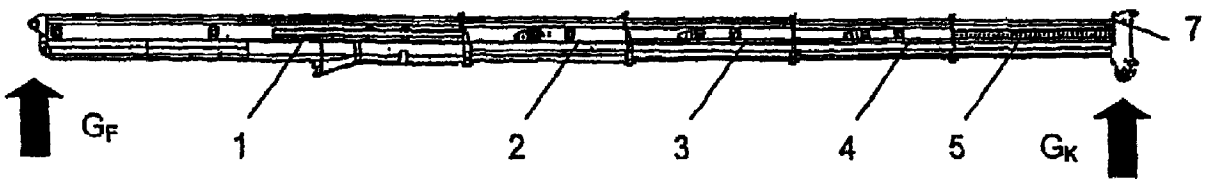
FIG. 2 shows a diagram of an extended telescoping boom.

The core of the present invention is to be seen in that, in order to compensate for the additional weight of the lifting capacity increasing arrangement, which is normally provided on the main boom of the mobile crane and is thus connected permanently to it, the individual telescoping sections are designed to be lighter in weight than the telescoping sections of conventional design for comparable working loads. This reduction in the weight of the telescoping sections means that the distribution of the total weight of the telescoping boom between the base weight $G_F$ and the top weight $G_K$, as illustrated in FIG. 2, is different than that of the conventional design. According to the invention, the ratio of the top weight $G_K$ to the base weight $G_F$ is less than 40:60. Practical examples of this ratio will usually be in a range of 40:60 to 30:70. In the case of telescoping sections with cross sections of conventional design, the ratio $G_K$:$G_F$ is always greater than 40:60, namely, for example, 42:58. In an advantageous embodiment of the invention, this ratio, however, will have a value of approximately 38:62.

Figure 3:
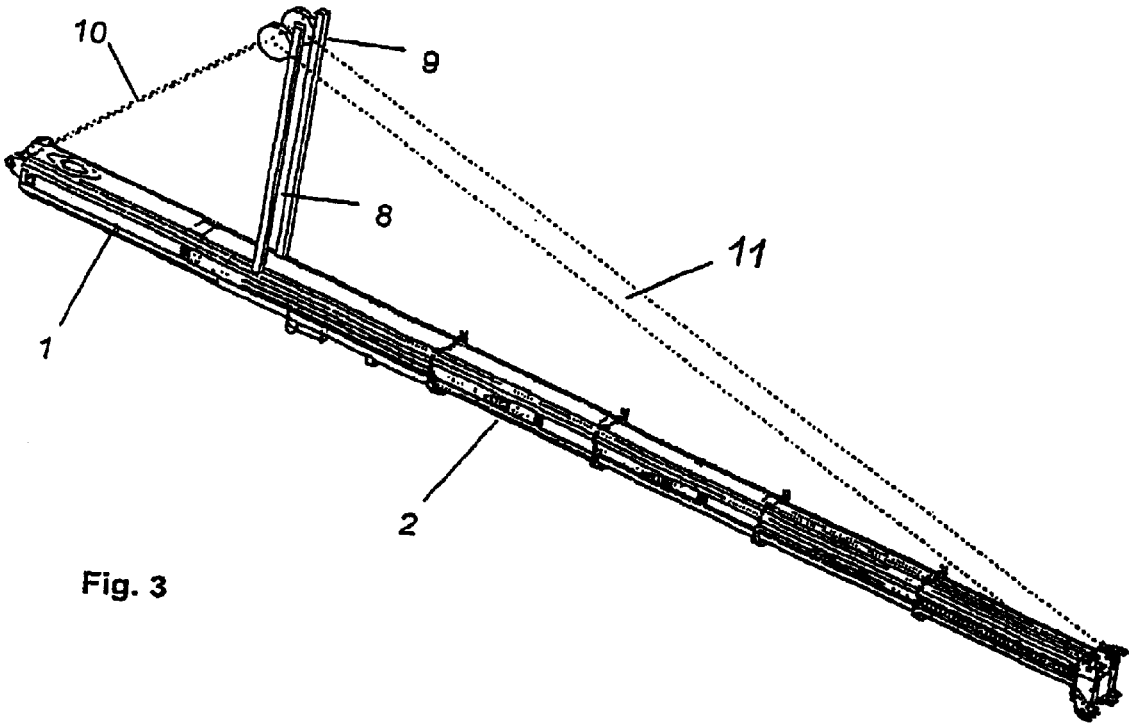
FIG. 3 shows a telescoping boom with a lifting capacity increasing arrangement acting in the load plane.

FIG. 3 shows an extended telescoping boom of the type according to the invention, which is provided with a lifting capacity increasing arrangement designed with guying which consists virtually of only a single strand. The two strands of the guying 11, shown in dotted line, are parallel to each other and only a short distance apart. Therefore, they cannot increase the stability in the plane transverse to the load plane and thus function in the same way as guying consisting in fact of a single strand. The guy support points vertically upward from the longitudinal axis of the boom and lies within the load plane. The latter is also true for the lower guying 10 and the upper guying 11. The cable drum at the upper end of the guy support 8 is designated by the reference number 9. Because of the way in which the lifting capacity increasing arrangement is constructed, it can increase the stiffness and buckling strength of the telescoping boom only in the direction of the load plane.

Figure 4:
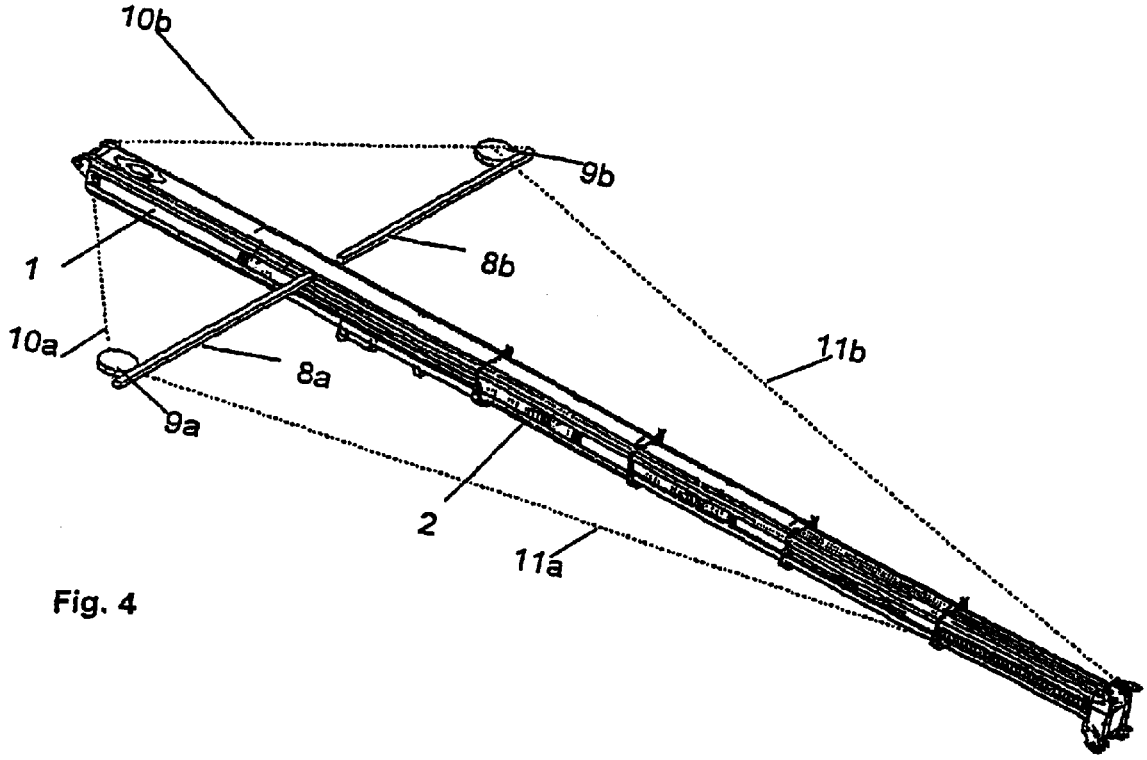
FIG. 4 shows a telescoping boom with a lifting capacity increasing arrangement acting in the plane transverse to the load plane.

FIG. 4, in contrast, shows a telescoping boom with a lifting capacity increasing arrangement capable of increasing the stiffness of the main boom transversely to the load plane. For this purpose, the guy support is formed by two guy struts 8*a*, 8*b*, which extend horizontally outward toward the right and toward the left from the base box unit 1 of the telescoping boom. Accordingly, two separate strands are provided for the guying, which are designated by the reference numbers 10*a*, 11*a* and 10*b*, 11*b* and which function in the same way as the guying of FIG. 3.

Figure 5:
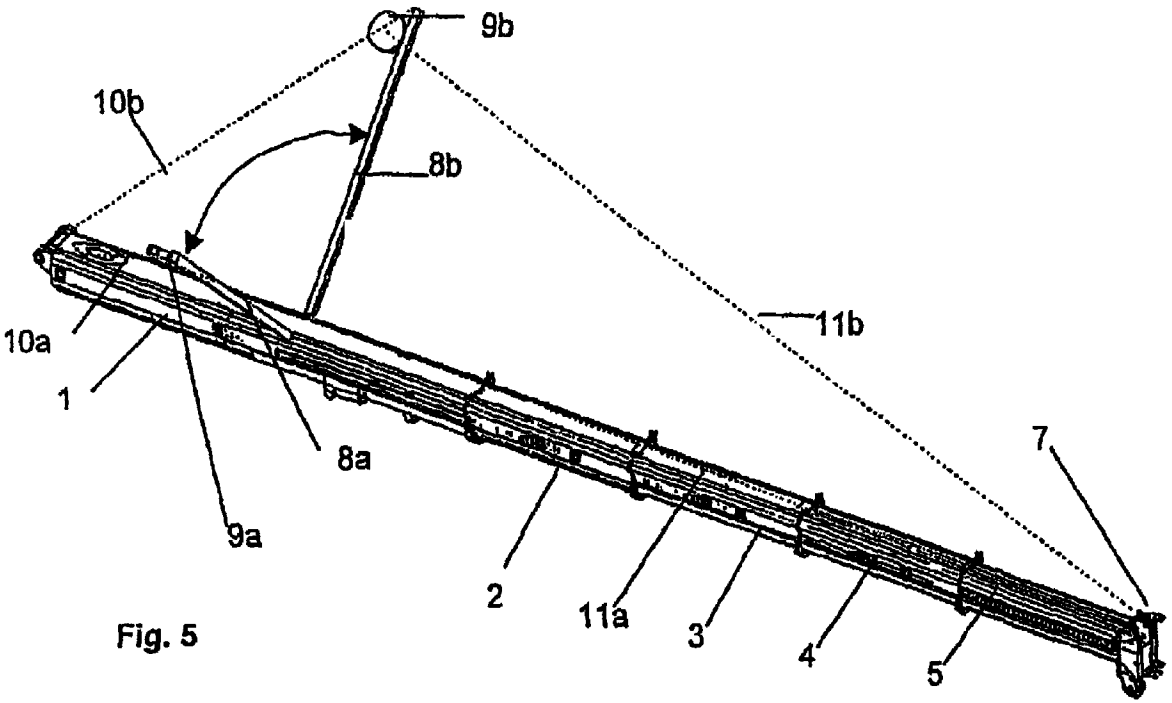

Another variant of a lifting capacity increasing arrangement is shown in FIG. 5. This design combines the effects of the designs according to FIGS. 3 and 4. For this purpose, the guy support consists again of two guy struts 8*a*, 8*b*. Although these struts also extend toward the right and toward the left, perpendicular to the longitudinal axis of the telescoping boom, they enclose an angle between them, which is indicated by a corresponding double arrow. The two struts 8*a*, 8*b* spread apart from each other as they proceed outward. As a result, the guying has force components both in the direction of the load plane and in the direction transverse to said plane. Therefore, this type of lifting capacity increasing arrangement can increase the stiffness and buckling strength of the telescoping boom not only in the load plane, but also in the plane transverse to that plane. The angle between the struts 8*a*, 8*b* is preferably adjustable in the range of 0–180° and will be selected as a function of the requirements in the actual case.

Figure 6:
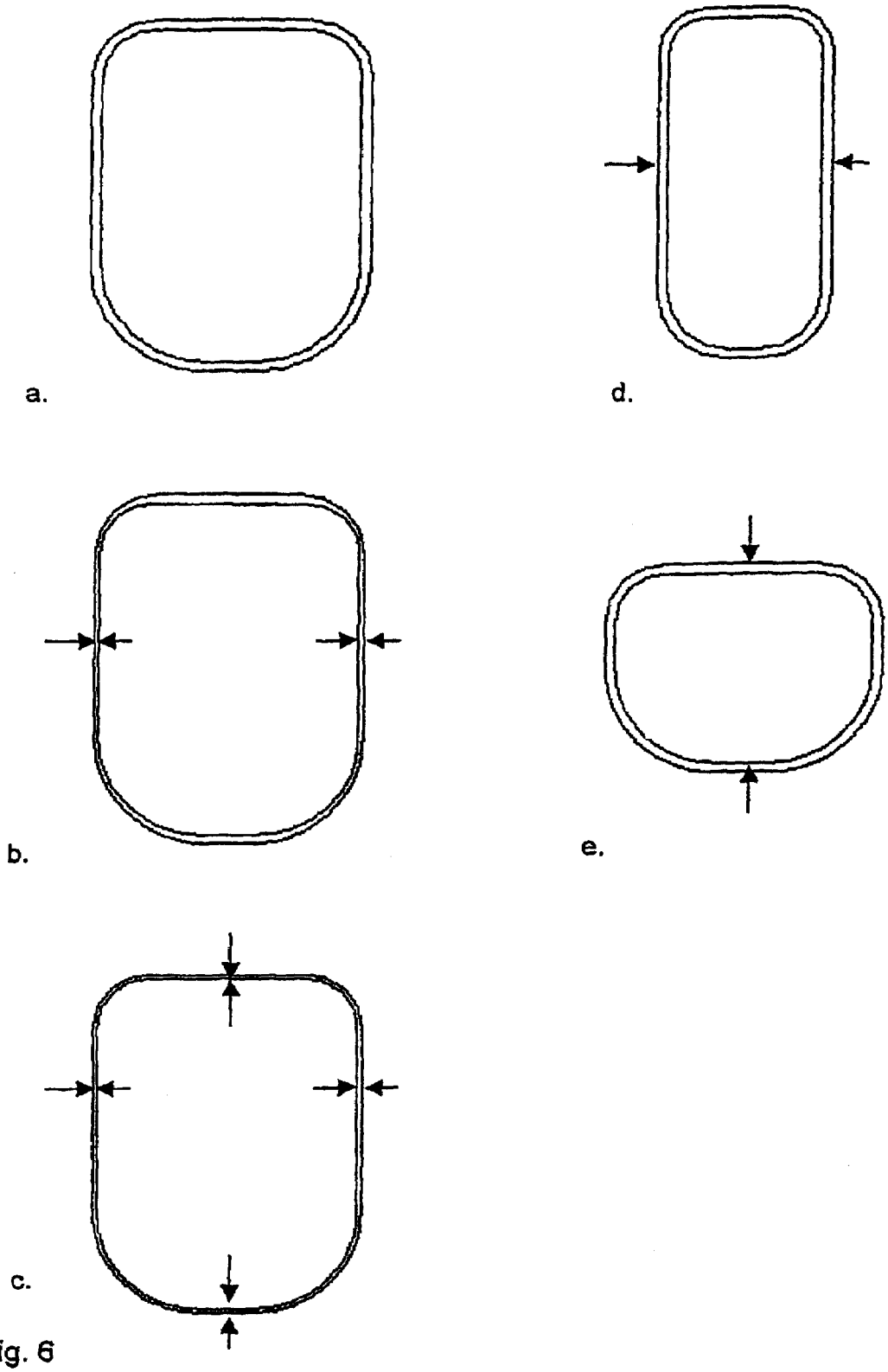
FIG. 6 shows various profile cross sections of the telescoping sections.

FIGS. 6*a*–*e* show schematic diagrams of various profiles of the telescoping sections. The cross-sectional shape is essentially box-like with rounded corners. The radii with which the corners are rounded in the lower part of the box profile, however, are considerably greater than those in the upper part of the profile. In FIG. 6*a*, a cross section is shown which corresponds to that of a telescoping section of conventional design. The selected wall thickness is intentionally exaggerated in comparison with the way it would actually appear so that the deviations in the design of the profile according to the invention will show up more clearly. FIG. 6*b* shows that the sidewalls are thinner than those of the conventional design according to FIG. 6*a*, as indicated by the arrows. The decrease in the wall thickness of the sides is more than compensated according to the invention by the lifting capacity increasing arrangement, so that, overall, an increase in the lifting capacity is obtained. FIG. 6*c* shows that, in addition to the sidewalls, the lower chord and the upper chord can also be made thinner. FIG. 6*d* shows that the weight of the telescoping section in question can also be reduced by decreasing the width of the profile. FIG. 6*e* shows how the weight can be reduced by decreasing the height of the profile.

What is claimed is:

1. A mobile crane comprising:

an undercarriage supported on axles having axle load limits;

a superstructure mounted rotatably on the undercarriage;

a main boom supported on the superstructure so that the main boom can rotate about a horizontal axis through a load plane, thereby having a variable rake, the main boom comprising a base box unit and a plurality of telescoping sections which can be extended from the base box unit to a maximum length of the main boom;

a hydraulic luffing ram hinged to the superstructure and the base box unit for adjusting the rake of the main boom; and a lifting capacity increasing arrangement for increasing the lifting capacity of the main boom, the arrangement being permanently connected to the base box unit and having a weight which is included in a total weight of the main boom, the individual telescoping sections being arranged and dimensioned so that the total weight of the main boom does not exceed a maximum weight defined by the axle load limits, and so that a ratio of a top weight of the fully extended main boom, measured in a horizontal position of the main boom on an upper end of the main boom, to a base weight of the fully extended main boom, measured in a horizontal position of the main boom on a base end of the main boom, does not exceed 40:60.

2. A mobile crane as in claim 1 wherein the telescoping sections have sidewalls parallel to the load plane and endwalls transverse to the load plane, the sidewalls having a thickness which is less than a thickness of the endwalls.

3. A mobile crane as in claim 1 wherein cross-sections of the telescoping sections are decreased so that weights of the telescoping sections meet the requirements that the total weight of the main boom does not exceed a maximum weight defined by the axle load limits, and so that a ratio of a top weight of the fully extended main boom to a base weight of the fully extended main boom does not exceed 40:60.

4. A mobile crane as in claim 3 wherein the telescoping sections have a dimension transverse to the load plane which is decreased more than a dimension parallel to the load plane to meet the requirements.

5. A mobile crane as in claim 3 wherein the telescoping sections have a dimension parallel to the load plane, said dimension decreased to meet the requirements.

6. A mobile crane as in claim 5 wherein the lifting capacity increasing arrangement increases the stiffness of the main boom in the load plane.

7. A mobile crane as in claim 4 wherein the lifting capacity increasing arrangement increases the stiffness of the main boom in a plane transverse to the load plane.

8. A mobile crane as in claim 5 wherein, the lifting capacity increasing arrangement comprises guying which extends from a point at the upper end of the main boom to a point at the base end of the main boom.

9. A mobile crane as in claim 8 wherein said guying comprises at least one guying cable, at least one guy support, and at least one cable drum.

10. A mobile crane as in claim 9 wherein the at least one guying cable comprises a fixed length section.

11. A mobile crane as in claim 9 wherein the at least one guy support comprises a pair of guy struts having longitudinal axes forming an angle therebetween, wherein said angle is adjustable, said guying comprising a pair of cables supported by respective struts.

12. A mobile crane as in claim 9 wherein the at least one guying cable is windable on the at least one cable drum, said at least one cable drum being mounted on said at least one strut and being removable from said at least one strut.

13. A mobile crane as in claim 1 wherein the lifting capacity increasing arrangement increases the stiffness of the main boom in the load plane and in a plane transverse to the load plane.

14. A mobile crane as in claim 13 wherein the lifting capacity increasing arrangement comprises means for adjusting the stiffness of the main boom in the load plane and in the plane transverse to the load plane.

15. A mobile crane as in claim 1 further comprising a road transport unit having three to nine axles supporting said undercarriage.

* * * * *